US005530633A

United States Patent [19]

Yuen

[11] Patent Number: 5,530,633

[45] Date of Patent: Jun. 25, 1996

[54] COMBINATION ELECTRIC TORCH

[75] Inventor: Se-Kit Yuen, Kowloon, Hong Kong

[73] Assignee: John Manufacturing Limited, Kowloon, Hong Kong

[21] Appl. No.: 377,271

[22] Filed: Jan. 24, 1995

[30] Foreign Application Priority Data

Jan. 24, 1994 [GB] United Kingdom ..... 9401245

[51] Int. Cl.[6] ..... F21L 11/00

[52] U.S. Cl. ..... 362/184; 362/199; 362/427; 362/300; 362/303

[58] Field of Search ..... 362/285, 287, 362/302, 307, 184, 197, 199, 202, 205, 206, 301, 228, 293, 427, 217, 200, 269, 300, 303

[56] References Cited

U.S. PATENT DOCUMENTS 1,899,868 2/1933 Herlbauer ..... 362/199
3,053,978 9/1962 Rhoades ..... 362/184
4,464,706 8/1984 Steeves, Jr. ..... 362/193
4,609,976 9/1986 Geissler ..... 362/202
4,977,489 12/1990 Fung ..... 362/184
5,217,297 6/1993 Yuen ..... 362/184

*Primary Examiner*—Denise L. Gromada
*Assistant Examiner*—Thomas M. Sember
*Attorney, Agent, or Firm*—John T. McNelis

[57] ABSTRACT

A combination electric torch that utilizes a swivelable headlamp portion (2) that in its first position can project light forward of the body portion (1) of the torch and in its second position can project light onto a warning reflector (7), in which second position the torch may be used as a warning lamp (3). An arm (5) is provided on the body portion (1) of the torch which has a rotatable cover (10) for protecting an auxiliary lamp (11), such as fluorescent tube, from damage. Because the headlamp portion (2) can be swiveled to a safe position adjacent the warning reflector (7) the design comprises a rugged construction less susceptible to damage but can be used in a variety of ways such as that of a warning lamp, conventional flashlight and reading light.

13 Claims, 3 Drawing Sheets

COMBINATION ELECTRIC TORCH

BACKGROUND OF THE INVENTION

1. Field of the Invention

This invention relates to a combination electric torch of the type which includes a headlamp for projecting light and a hazard warning lamp.

2. Description of Background Art

Some conventional battery-operated torches include a facility for selectively providing a warning signal, for example, the torch disclosed in European Patent No. 0157356. In that patent, the torch is of cylindrical shape and the torch head is slidable in the direction of the torch beam to a position in which the reflector is moved away from the bulb and the bulb is therefore exposed. In this region of the torch a translucent collar is provided which is amber in color, so that when the bulb is exposed the torch can also act as a warning lamp. In this way, only one electric bulb is required, even though the torch can selectively carry out two functions by acting as a conventional torch or a hazard warning lamp. Other combination torches include two lamps, one for illuminating the headlamp portion and the other for illuminating a colored translucent lens which acts as a warning lamp.

A disadvantage of such conventional torches is that they are often susceptible to damage because the lenses are usually exposed. In particular, the headlamp lens is exposed because it is normally disposed at the extreme forward end of the torch. What is needed is a combination electric torch that is capable of being selectively used as either a conventional torch having an exposed headlamp portion, or as a warning lamp, wherein the electric torch may be stored in a position which does not expose the headlamp.

SUMMARY OF THE INVENTION

A combination electric torch comprising a body portion (1) for receiving battery power means, a headlamp portion (2) for projecting light and a warning reflector (7) on the body portion (1) for selectively providing a warning signal, wherein the headlamp portion (2) is swivelable between a first position in which it can project light forward of the body portion and a second position in which it can project light onto the warning reflector (7), in which second position the torch may be used as a warning lamp (3). This arrangement has the advantage in that it is able to perform the function of a combination electric torch of the type described using only one bulb, and is also able to ensure that the headlamp reflector is not exposed to accidental damage when in its stored position corresponding to the second position referred to above.

The torch has a body portion (1) which includes an arm (5) that is swivelably mounted to the headlamp portion (2). The headlamp is located at or near the free end of the arm (5). The arm (5) may include an openable cover (10), such as swivelable cover, within which is disposed an auxiliary lamp (11), such as a fluorescent lamp, so that an additional light source may be available if desired. The cover (10) may include or be connected to a switch (13) so that when the cover (10) is in its closed position, the auxiliary lamp (11) is off and when the cover (10) is open, the lamp (11) is switched on.

Preferably, the warning reflector (7) is disposed between the headlamp portion (2) and the body portion (1) of the torch such that when the headlamp portion (2) is moved to its second position it projects light onto the warning reflector (7) to thereby provide a warning lamp (3) without the need for an additional bulb. The warning reflector (7) may be generally conical in shape with the apex pointing toward the headlamp portion (2) when in its second position so that light may be reflected from the headlamp outwards to act as a warning. The warning reflector (7) is preferably surrounded by an amber translucent collar (8) to operate as a warning light when in the second position.

The body portion (1), the collar (8) and the headlamp portion (2) are generally cylindrical having approximately the same diameter. The collar (8) is rotatable and cooperable with the switch (13) to selectively permit switching the headlamp on and off, either manually or intermittently.

The torch includes a flat base at the end of the body portion that is remote from the headlamp portion so that the headlamp portion can be held upright relative to the body portion. The headlamp portion (2) may be swiveled to any position at or between its first and second positions. In this embodiment, it will be readily appreciated that the torch may then also act as an adjustable reading light since the headlamp portion can be swiveled to any convenient angle.

The invention can be used for a variety of functions and incorporates the ability to be stored with less risk of damage for the headlamp lens than in previous lamps.

DETAILED DESCRIPTION OF THE PREFERRED EMBODIMENTS

Figure 1:
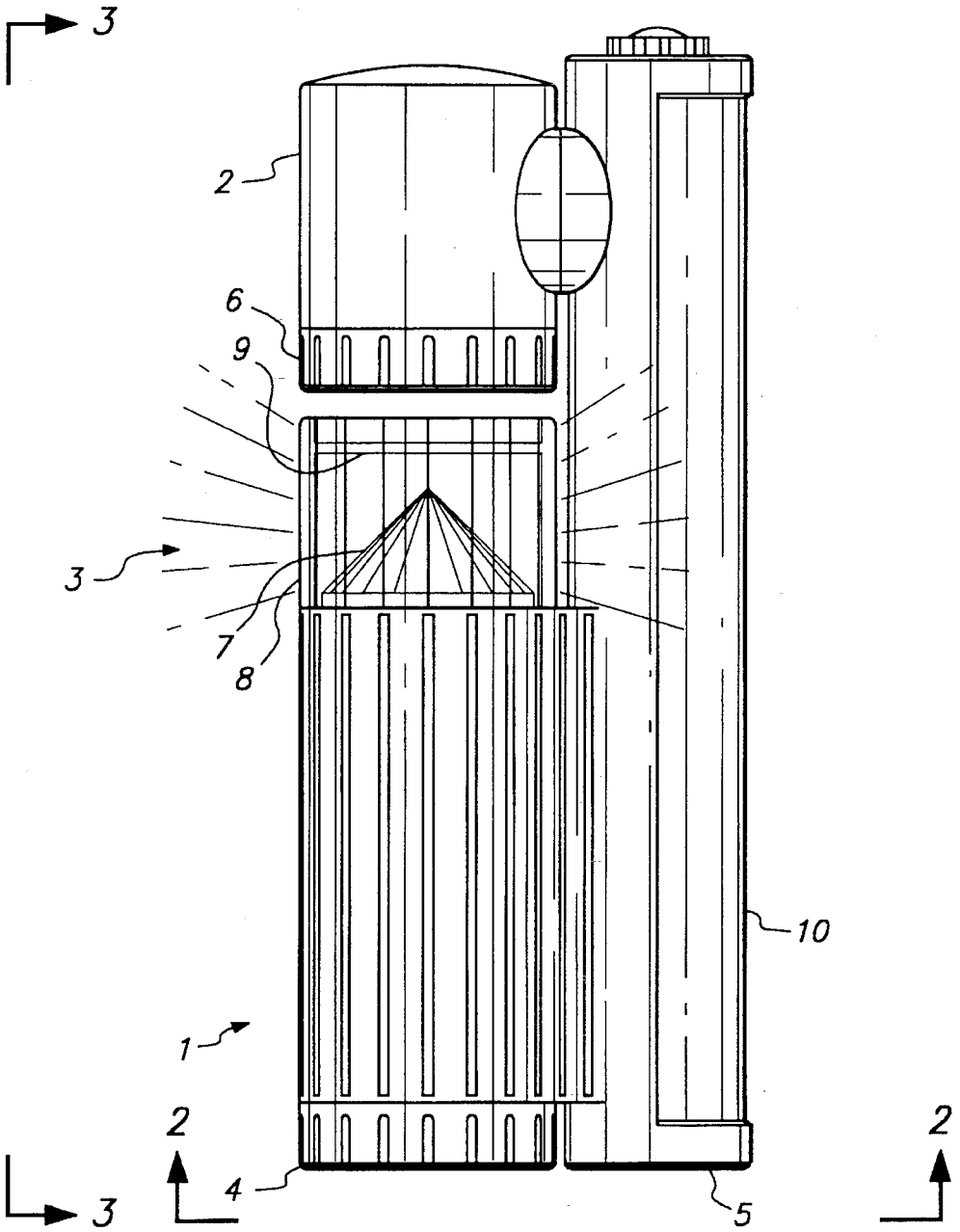
FIG. 1 is a side view of a combination torch according to a preferred embodiment.
Figure 2:
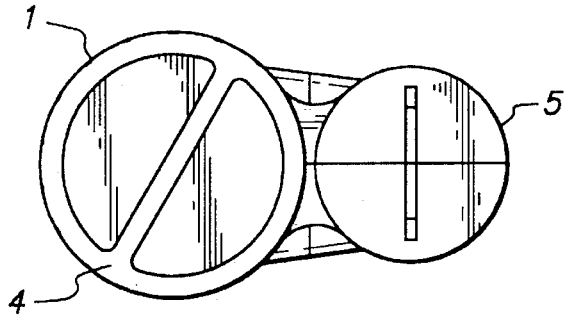
FIG. 2 is a view of the torch of FIG. 1 from the direction marked in 2—2.

Referring to the drawings, there is shown in FIG. 1 a combination torch comprising a body portion 1, a headlamp portion 2 and a warning lamp 3. The body portion 1 is generally cylindrical, as can be seen from FIG. 2, and includes an aperture through which batteries may be inserted or removed, covered by a screw-on cap 4.

As shown in FIG. 1, a generally cylindrical arm 5 is fixed to the side of the body portion 1 and near to the free end thereof the headlamp portion 2 is swivelably mounted on a pivot (not shown). In the position shown, the headlamp reflector (not shown) is pointed towards the warning lamp 3 and is retained in place by a screw-on cap 6 of conventional form.

The warming lamp 3 comprises a warning reflector 7 of conical shape, the apex of which points towards the central axis of the headlamp portion 2. The reflector 7 has a reflective surface so that when light from the headlamp portion 2 impinges thereon, it is reflected generally outwardly in the manner shown. The reflector 7 is housed within a cylindrical translucent collar 8 which includes an upper window 9 to permit light from the headlamp portion 2 to strike the reflector 7. The collar 8 is preferably amber in color so that a warning signal may be perceived by a viewer.

The arm 5 permits the headlamp portion 2 to be swiveled and is covered with a rigid semi-cylindrical cover 10 that is slidably openable about the longitudinal axis of the arm 5 in a manner to be described below with reference to FIG. 5.

In the position shown in FIG. 1, the optical parts of the torch, with the exception of the warning lamp 3, are protected from damage and in this position the torch may be selectively turned on or off. By virtue of the generally flat configuration of the cap 4 the torch is able to stand upright and the warning lamp, if illuminated by the headlamp portion 2, can act as a free-standing warning beacon.

Figure 3:
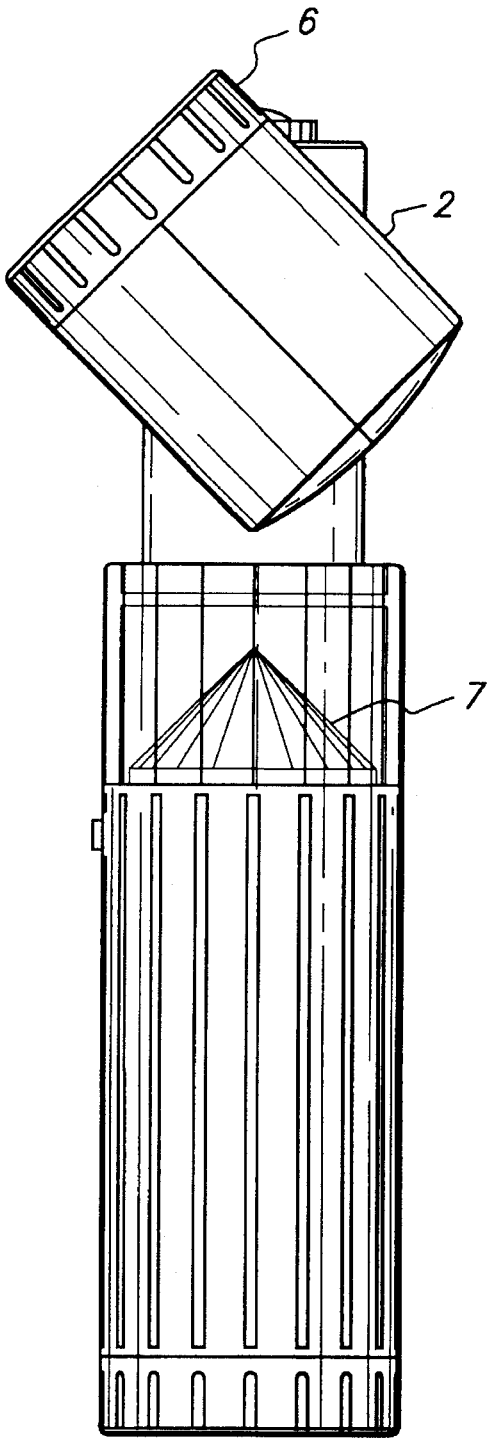
FIG. 3 is a side elevation of the torch of FIG. 1 from the direction marked 3—3.

FIG. 3 illustrates a side view of the combination torch in the direction of arrow 3—3 as shown in of FIG. 1. In FIG. 3, the headlamp portion 2 has been swiveled approximately 135 degrees from the position illustrated in FIG. 1. In this swiveled position, if the headlamp portion 2 is switched on a beam of light will not strike the warning reflector 7 but will instead be projected outwardly along the principal axis of the headlamp portion, i.e., at approximately 135 degrees.

Figure 4:
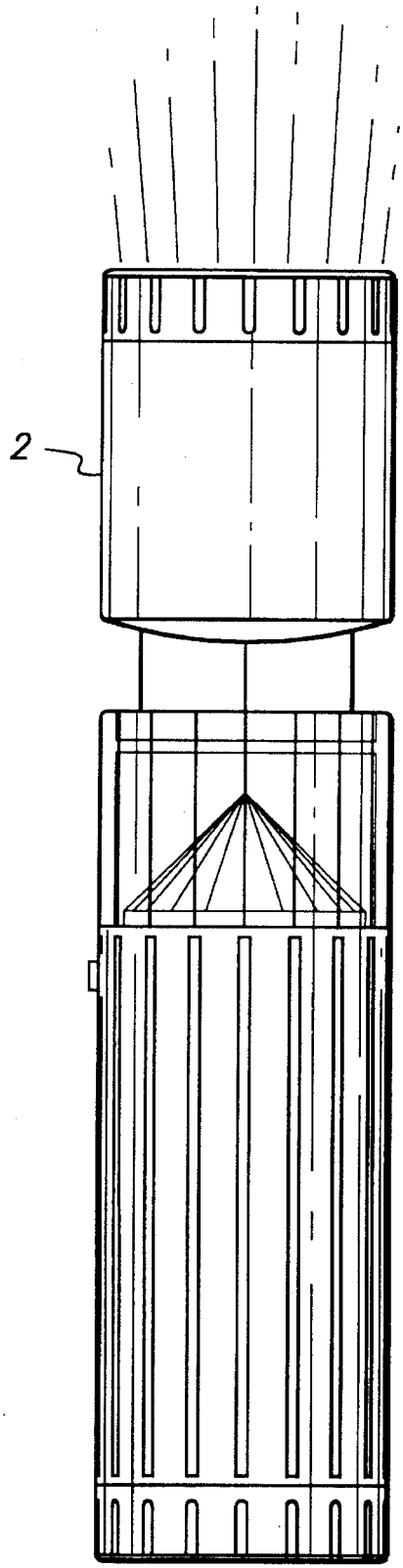
FIG. 4 is a further elevation corresponding to that of FIG. 3 but showing the headlamp portion in its first position.

FIG. 4 illustrates a side view of the combination torch in the direction of arrow 3—3 as shown in FIG. 1. In FIG. 4, the headlamp portion 2 has been swiveled to its fullest extent, i.e., approximately 180 degrees from the position illustrated in FIG. 1, corresponding to the first position referred to above and in which light emitting from the headlamp portion 2 is projected forwardly of the torch in a conventional manner.

Figure 5:
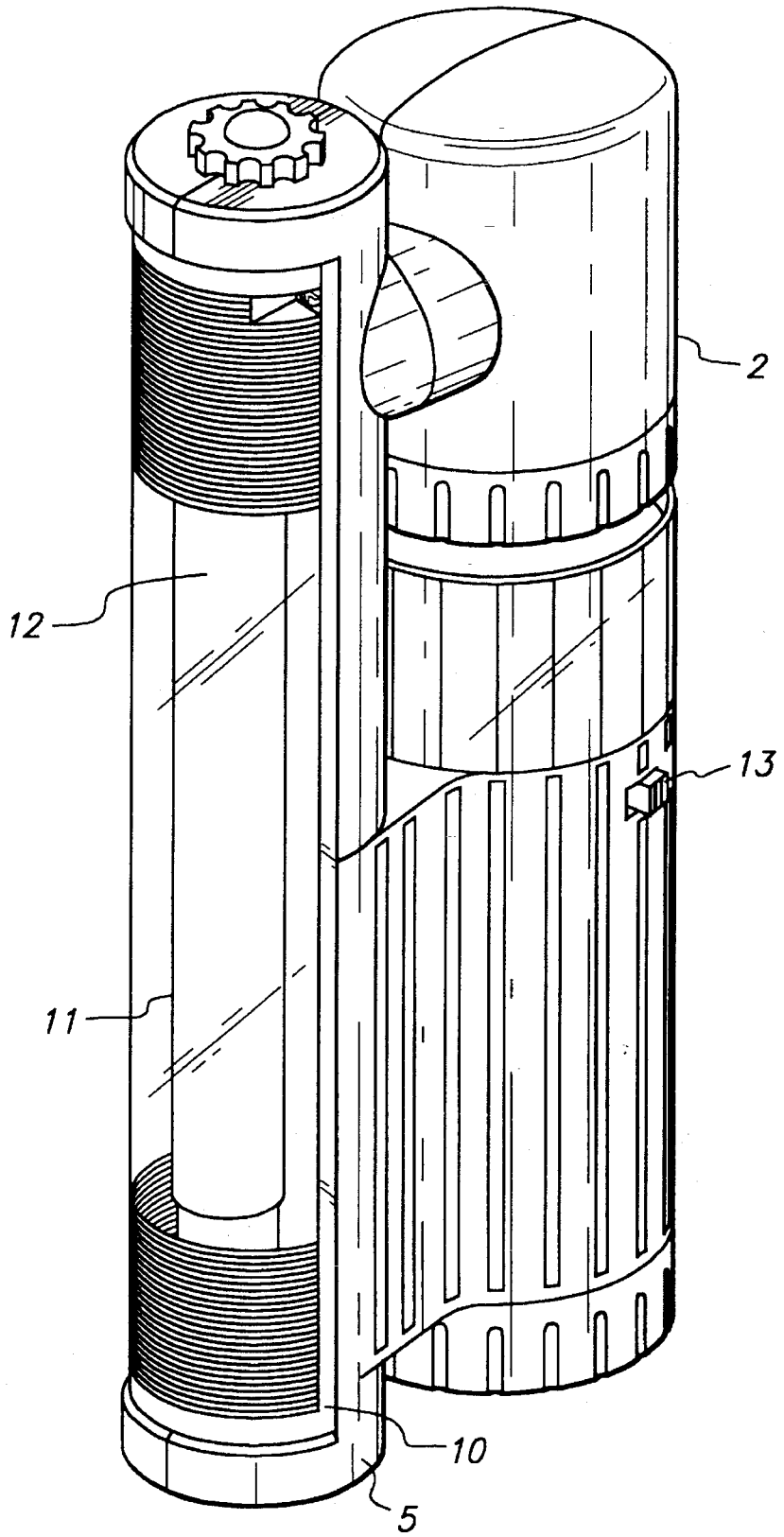
FIG. 5 is a perspective view of the torch of FIG. 1 showing the auxiliary lamp in its exposed position.

Turning now to FIG. 5, there is shown a perspective view of the torch of FIG. 1 wherein the cover 10 has been rotated (swiveled) about the longitudinal axis of the arm 5 to expose an auxiliary lamp in the form of a fluorescent tube 11 housed within a clear plastic cover 12 having a shape corresponding to the shape of the cover 10. Switch means 13 are provided on the outer surface of the body portion 1 to selectively activate the auxiliary lamp 11, or the headlamp portion 2, whichever is desired.

It will therefore be apparent that the torch according to the preferred embodiment of the invention is extremely versatile and can be used for general lighting purposes at very low power levels by utilization of the auxiliary lamp 11, or as a warning light. When used as a warning light, a separate illumination source is not necessary since the headlamp portion can be utilized for such a purpose. The headlamp portion itself may be moved to the position shown in FIG. 4 for conventional use, or may be used as a reading lamp with the headlamp portion 2 being swiveled to any desired position between its first and second positions. When the torch is not in use, the cover 10 can be moved to the position shown in FIG. 1 and the headlamp portion 2 can be rotated to its second position, such that the torch is generally compact and rugged and less likely to be accidentally damaged.

The above description is included to illustrate the operation of the preferred embodiments and is not meant to limit the scope of the invention. From the above discussion, many variations will be apparent to one skilled in the art that would yet be encompassed by the spirit and scope of the invention.

What is claimed is:

1. A combination electric torch comprising:

a body portion;

a warning reflector, located within said body portion, for selectively providing a warning signal; and a headlamp portion, swivelably coupled to said body portion, to rotate through 180 degrees between a first position in which said headlamp portion can project light in a direction away from the body portion, and a second position in which said headlamp portion can project light onto said warning reflector, a longitudinal axis of said headlamp portion being co-axial in each of said two positions with the longitudinal axis of said body portion.

2. The torch of claim 1, wherein said body portion further comprises an arm having a free end, said headlamp portion swivelably coupled to said free end.

3. The torch of claim 2, wherein said arm is generally cylindrical and lies in a plane coincident with a longitudinal axis of the body portion.

4. The torch of claim 3, wherein said arm further comprises an openable cover having a supplemental lamp disposed within.

5. The torch of claim 4, wherein said supplemental lamp is a fluorescent lamp.

6. The torch of claim 4, wherein said supplemental lamp is on when said cover is in an open position and said supplemental lamp is off when said cover is in a closed position.

7. The torch of claim 1, wherein said warning reflector is disposed between said headlamp portion; and said body portion, said headlamp portion projecting light onto the warning reflector when said headlamp portion is in said second position.

8. The torch of claim 7, wherein said warning reflector is generally conical in shape, with the apex pointing toward said headlamp portion when said headlamp portion is in said second position.

9. The torch of claim 8, wherein said warning reflector is surrounded by a translucent collar.

10. The torch of claim 9, wherein said translucent collar is colored.

11. The torch of claim 10, wherein said body portion and said translucent collar are generally cylindrical and have a corresponding diameter.

12. The torch of claim 11, further comprising a switch means responsive to said collar, wherein said collar is rotatable and co-operable with said switch means to selectively permit the headlamp to be switched on or off.

13. The torch of claim 12, wherein an end of said body portion that is remote from said headlamp portion has a flat base to permit said headlamp portion to be held upright while in one of said first position, said second position, and a position between said first position and second position.

* * * * *